United States Patent [19]

van Zeggeren

[11] 3,944,038

[45] Mar. 16, 1976

[54] ENERGY DISSIPATING DEVICE FOR COIN HANDLING MECHANISMS

[75] Inventor: Wilhelm Aart van Zeggeren, Bleiswijk, Netherlands

[73] Assignee: Mars, Inc., McLean, Va.

[22] Filed: Nov. 21, 1974

[21] Appl. No.: 525,742

[30] Foreign Application Priority Data

Nov. 22, 1973 United Kingdom ..... 54318/73

[52] U.S. Cl. ..... 194/1 K

[51] Int. Cl.[2] ..... G07F 3/02

[58] Field of Search ..... 194/1 K, 100 R, 100 A, 194/99, 100, 101, 102, 103, 1 R; 267/136, 139; 133/1 R

[56] References Cited

UNITED STATES PATENTS

| | | | |
|---|---|---|---|
| 1,280,540 | 10/1918 | Pollock | 194/100 R |
| 1,751,120 | 3/1930 | Wurzbach | 194/100 A |
| 1,756,076 | 4/1930 | Wurzbach | 194/100 R |
| 3,837,454 | 9/1974 | Joeck | 194/100 A |

*Primary Examiner*—Allen N. Knowles

*Attorney, Agent, or Firm*—Davis, Hoxie, Faithfull & Hapgood

[57] ABSTRACT

A device for dissipating the kinetic energy that causes bouncing which might otherwise effect the results of the coin tests in coin handling apparatus. The device consists of a piece of very hard material such as sintered aluminum oxide which is mounted on the frame of the mechanism and is arranged to be struck by coins travelling along a path through the coin handling mechanism.

15 Claims, 4 Drawing Figures

ENERGY DISSIPATING DEVICE FOR COIN HANDLING MECHANISMS

This invention relates to devices for causing the dissipation of some or substantially all of the kinetic energy of a coin in a coin handling mechanism.

There are a number of types of coin handling mechanisms in which a coin, token, or similar metal article is guided through the mechanism rolling or sliding on its edge or sliding on one of its faces. Examples of this type of mechanism are the devices used in coin operated vending machines to identify and authenticate a coin deposited in the machine. In many of these coin handling mechanisms the path followed by the coin is quite serpentine, involving several abrupt changes of coin direction. Along any leg of this path, the coin may be subjected to tests (e.g. tests of coin genuineness) which depend on accurate positioning of the coin. The coin may also be required to drop from one leg of the path to another and then continue along the second leg, preferably with a minimum of coin bouncing. At many places in these mechanisms, particularly where falling coins must be intercepted or changes of coin direction effected, devices for causing the dissipation of the kinetic energy of a coin are desirable.

In general, the efficiency of a coin handling mechanism depends on how rapidly coins can be processed by the mechanism. Thus it is desirable to be able to move coins through the mechanism at relatively high velocities. On the other hand, as the coin velocities involved are increased, the coins possess more kinetic energy, and it becomes more difficult to change coin direction without causing vibration and bouncing.

In many applications, coin handling mechanisms must be able to handle several different coin denominations in a coin set, processing all of these coins at least partly along a common path. The coins to be processed may vary considerably in diameter, thickness, mass, elasticity, etc. However, the energy dissipating devices (at least those along the portion of the path followed by all coins) must efficiently dissipate the kinetic energy of all the coins to be processed.

One such device, which absorbs the kinetic energy of the coin, is disclosed in U.S. Pat. No. 3,889,792 and assigned to the assignee of the present application. The energy absorbing device shown in FIG. 6 of that specification is a composite construction having a relatively hard coin strike plate mounted on a cushion of relatively soft elastic material which in turn is mounted on one leg of an L-shaped bracket of a relatively hard material. The other leg of the bracket is secured to a wall of the mechanism through a pad of soft elastic material so that the strike plate lies across the path of the coins. The various elements of the energy absorbing device disclosed are held together by a suitable adhesive material. By dimensioning the various components of the device as disclosed in that application, it can be made to absorb substantially all of the kinetic energy of United States 5-, 10- and 25 cent coins dropped from a height of approximately 1½ inches.

While the composite energy absorbing device just described performs adequately, the necessary assembly operations and to the cost of the coin handling mechanism, and accordingly a simpler device is desirable.

According to the present invention there is provided a coin handling mechanism including means defining a coin path through the mechanism, the means including at least one energy dissipating device arranged to be struck by a coin travelling along the path and cause a change in direction of the path, the energy dissipating device comprising a solid piece of material having a hardness value greater than 9 on the Mohs scale.

The material may be a ceramic, such as sintered aluminium oxide. The piece may be bolted or otherwise secured directly to the frame of the mechanism.

Because the sintered aluminium oxide is much harder than any commonly used coins, it appears that the kinetic energy of the coin is largely dissipated in the coin, in contrast to the device disclosed in the specification discussed above.

Thus the invention provides a simple, inexpensively assembled energy dissipating device for use in coin handling mechanisms which efficiently dissipate some or substantially all of the kinetic energy of a coin moving through the mechanism. The device is effective to dissipate the kinetic energy of coins varying widely in diameter, thickness, mass, elasticity, etc.

An embodiment of the invention will now be described, by way of example, with reference to the accompanying drawings, in which.

Figure 1:
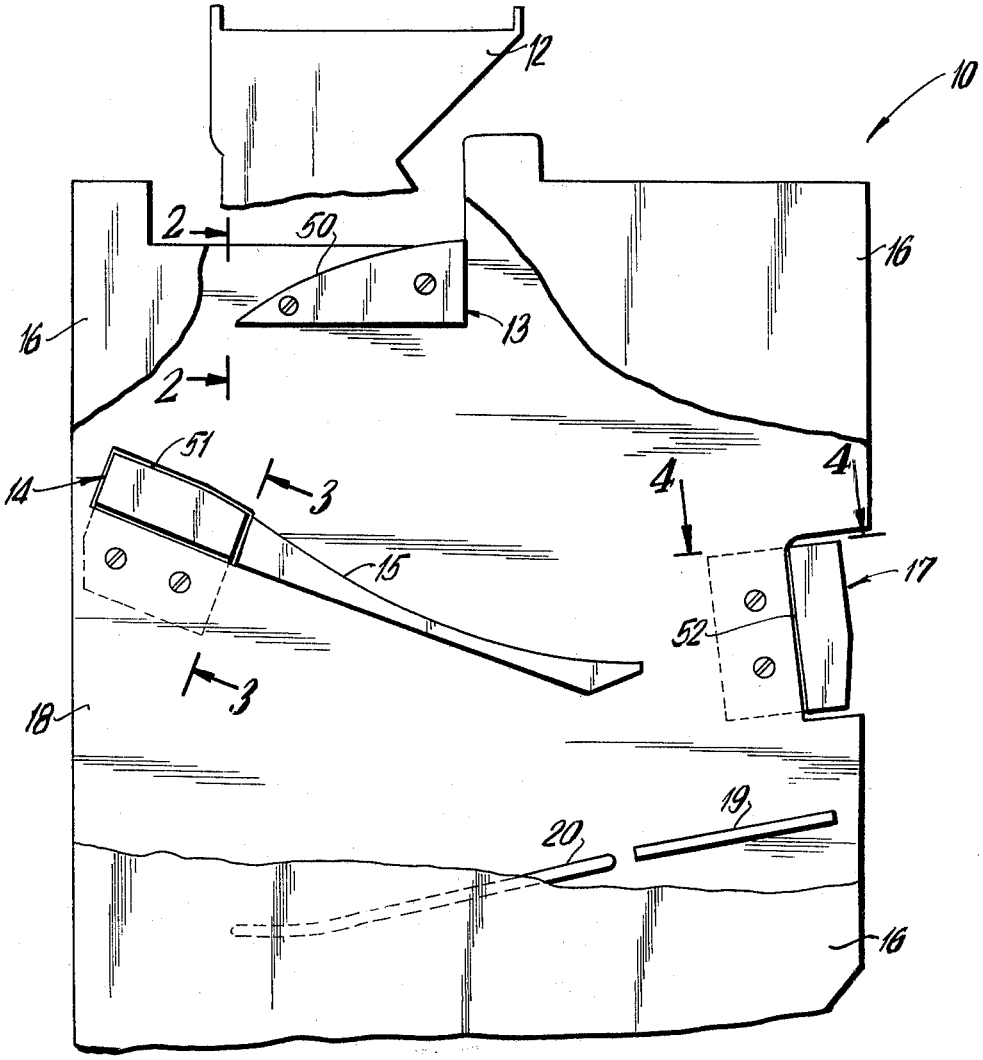
FIG. 1 is a fragmentary elevational view of a portion of a coin handling mechanism in which energy dissipating devices constructed in accordance with the present invention are employed.

FIG. 1 shows part of a coin mechanism 10 for use in identifying and authenticating coins of any of several denominations in a coin set (e.g. the United States 5-, 10-, and 25 cent coins) as is required, for example, in a coin-operated vending machine. Examples of coin mechanisms having this capability are those described in U.S. Serial No. 255,814 filed May 22, 1972 and assigned to the assignee of the present application.

The tests used to identify and authenticate coins are performed by devices which incorporate sensors (not shown) positioned along the track to be traversed by the coins. These tests may be quite sensitive to the location of coins relative to the sensors, and therefore the motion of a coin past the sensors must be entirely sliding or rolling motion rather than bouncing motion.

Figure 2:
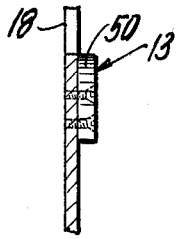
FIG. 2 is a sectional view taken along the line 2—2 of FIG. 1 of a first energy dissipating device in the mechanism of FIG. 1.

In the coin mechanism 10 of FIG. 1, a coin is inserted through a coin entry 12 and is directed by the shape of that entry, under the influence of gravity, between sidewalls 16 and 18, onto the coin strike surface 50 of a first energy dissipating device 13. The entry is shaped to ensure that all coins are directed onto the strike surface 50. The sidewalls 16 and 18 are parallel plates spaced apart by at least the thickness of the thickest coin to be processed by the apparatus (e.g. the United States 5-cent coin). If desired, the sidewalls 16 and 18 may be tilted slightly from the vertical so that the face of a coin rolling down a coin track 15 (and later a coin track 20) bears on one sidewall such as front sidewall 16. The energy dissipating device 13, as shown in FIGS. 1 and 2, is a solid block of sintered aluminium oxide which causes the dissipation of all or substantially all of the kinetic energy of any acceptable coin in the coin set (e.g. genuine 5-, 10-, and 25 cent coins) which drops onto it from the entry 12. In this way a coin is effectively brought momentarily to rest on the surface 50 of the energy dissipating device 13 and then begins to roll down the surface 50 without bouncing.

In the embodiment of the coin mechanism 10 shown in FIG. 1, the coin strike surface 50 of the energy dissipating device 13 has a straight section sloping downwards at an angle of 12° to the horizontal followed by a curved section having a radius of curvature of 40 millimeters. The device 13 is 2.3 millimeters in thickness, 6 millimeters in height at its right-hand edge as shown in FIG. 1 and 36 millimeters in length.

Figure 3:
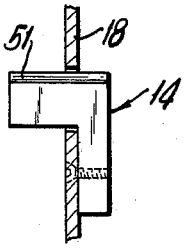
FIG. 3 is a sectional view taken along the line 3—3 in FIG. 1 of a second energy dissipating device in the mechanism of FIG. 1.

After rolling off device 13, coins fall vertically and with some right-to-left velocity as shown in FIG. 1 onto a second energy dissipating device 14, mounted on the sidewall 18 of the mechanism. As shown in FIGS. 1 and 3, device 14 is an L-shaped block of aluminium oxide bolted or otherwise attached by one limb to the mechanism. The coin strike surface 51 of device 14 is provided on the other limb and has an initial straight section followed by a curved section having a radius of curvature of 65 millimeters. The device 14 is mounted in the mechanism at an angle to the horizontal such that the curved section merges smoothly with the beginning of coin track 15. In this embodiment the total length of the coin strike surface 51 is about 26 millimeters, and the thickness of the limb of the device including strike surface 51 is 9 millimeters. That same limb of device 14 has a depth, perpendicular to the plane of the sidewall 18, of 14 millimeters.

Because of its angle of inclination to the horizontal and its energy dissipating properties, coins falling onto the energy dissipating device 14 lose their right-to-left velocity and roll down the curved section of surface 51 onto the coin track 15. Sensors are located above the coin track 15, so that the presence of a coin is sensed while it is rolling along the coin track 15. By the time a coin reaches the end of a coin track 15, a decision has been made by the sensors and associated circuitry as to whether the coin is acceptable or not, and if acceptable, its denomination has been identified. The coin leaves the end of coin track 15 with an almost horizontal trajectory and strikes an energy dissipating device 17. Like the energy dissipating device 14, the device 17 causes the dissipation of substantially all of the kinetic energy of the coin, allowing it to drop almost vertically toward a coin acceptance gate 19. If the coin has been identified as acceptable, the coin acceptance gate is drawn into the sidewall 18 (e.g. by a solenoid not shown in FIG. 1) and the coin is allowed to drop onto a further track (not shown) for delivery to coin separator means as described, for example, in U.S. Serial No. 333,547 filed Feb. 20, 1973 and assigned to the assignee of the present application. If, as a coin leaves the end of the coin track 15, it has not been found acceptable, the coin acceptance gate 19 is not retracted. The gate 19 therefore intercepts the coin dropping from the energy dissipating device 17 and diverts it onto coin track 20. At the lower end of coin track 20, the rejected coin enters a coin chute (not shown) leading to the coin return window of the machine.

Figure 4:
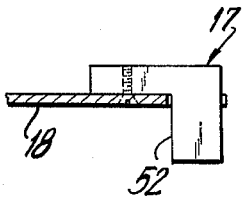
FIG. 4 is a sectional view taken along the line 4—4 in FIG. 1 of a third energy dissipating device in the mechanism of FIG. 1.

The energy dissipating device 17 is mounted on the sidewall 18 of the mechanism and is similar in dimensions to device 14. Unlike the device 14, however, the coin strike surface 52 of the device 17 is, as shown in FIGS. 1 and 4, an inner surface of one of the limbs of the L-shaped block. This choice of strike surface permits a compacting of the overall structure of the coin mechanism without a shortening of the coin path.

While all three devices are shown attached to sidewall 18 by bolts, other mounting methods may be employed. For example, the sidewall 18 may be provided with pins of appropriate lengths onto which the devices are placed during assembly.

While the present invention has been described in connection with the use of various United States coins, it is also applicable to coins and tokens of other nations or issuing authorities.

What we claim is:

1. A coin handling mechanism including means defining a coin path through the mechanism, the means including at least one energy dissipating device arranged to be struck by a coin travelling along the path and cause a change in direction of the path, the energy dissipating device comprising a rigidly mounted solid piece of material having a hardness value greater than 9 on the Mohs scale.

2. A coin handling mechanism according to claim 1 in which the material is a ceramic material.

3. A coin handling mechanism according to claim 2 in which the material is sintered aluminium oxide.

4. A coin handling mechanism to claim 1 in which the said piece is secured directly to a part of the frame of the mechanism.

5. A coin handling mechanism according to claim 4 in which the piece has an L-shaped cross-section, one limb of the L-shaped piece being secured to part of the frame of the mechanism, the other limb providing the surface which is struck by the coin.

6. A coin handling mechanism according to claim 2 in which the said piece is secured directly to a part of the frame of the mechanism.

7. A coin handling mechanism according to claim 6 in which the piece has an L-shaped cross-section, one limb of the L-shaped piece being secured to part of the frame of the mechanism, the other limb providing the surface which is struck by the coin.

8. A coin handling mechanism according to claim 3 in which the said piece is secured directly to a part of the frame of the mechanism.

9. A coin handling mechanism according to claim 8 in which the piece has an L-shaped cross-section, one limb of the L-shaped piece being secured to part of the frame of the mechanism, the other limb providing the surface which is struck by the coin.

10. A coin handling mechanism for identifying acceptable coins of one or more predetermined denominations including means defining a coin path through the mechanism, the means including at least one energy dissipating device arranged to be struck by a coin travelling along the path and cause a change in direction of the path, the energy dissipating device comprising a rigidly mounted piece of ceramic material having a hardness sufficiently greater than that of any coins of the predetermined denominations that the coin has substantially no bounce when it strikes the energy dissipating device.

11. A coin handling mechanism according to claim 10 wherein the ceramic material is aluminum oxide.

12. A coin handling mechanism according to claim 10 wherein one energy dissipating device forms the upstream end of a coin track down which coins can roll along the coin path past a coin identification sensor.

13. A coin handling mechanism according to claim 12 wherein the ceramic material is aluminum oxide.

14. A coin handling mechanism according to claim 10 wherein one energy dissipating device is past the downstream end of a coin track in the direction of coin trajectory from the said downstream end and spaced from said downstream end by at least the diameter of the largest coin acceptable by the mechanism.

15. A coin handling mechanism according to claim 14 wherein the ceramic material is aluminum oxide.

* * * * *

UNITED STATES PATENT AND TRADEMARK OFFICE

CERTIFICATE OF CORRECTION

PATENT NO. : 3,944,038

DATED : March 16, 1976

INVENTOR(S) : Wilhelm Aart van Zeggeren

It is certified that error appears in the above-identified patent and that said Letters Patent are hereby corrected as shown below:

Col. 1, line 64, "and" should be --add--.

Col. 4, (Claim 4) line 25, after "mechanism" insert --according--.

Signed and Sealed this

Twentieth Day of July 1976

[SEAL]

*Attest:*

RUTH C. MASON
*Attesting Officer*

C. MARSHALL DANN
*Commissioner of Patents and Trademarks*